United States Patent [19]

Profera

[11] 4,091,387

[45] May 23, 1978

[54] BEAM FORMING NETWORK

[75] Inventor: Charles Edward Profera, Cherry Hill, N.J.

[73] Assignee: RCA Corporation, New York, N.Y.

[21] Appl. No.: 794,129

[22] Filed: May 5, 1977

[51] Int. Cl.[2] ..... H01Q 19/06; H01Q 3/26

[52] U.S. Cl. ..... 343/754; 343/854; 343/786

[58] Field of Search ..... 343/854, 100 SA, 777, 343/776, 778, 754, 786

[56] References Cited

U.S. PATENT DOCUMENTS

| | | | |
|---|---|---|---|
| 3,100,894 | 8/1963 | Giller et al. | 343/776 |
| 3,245,081 | 4/1966 | McFarland | 343/854 |
| 3,631,503 | 12/1971 | Tang et al. | 343/854 |

*Primary Examiner*—Archie R. Borchelt
*Assistant Examiner*—David K. Moore
*Attorney, Agent, or Firm*—Leonard Weiss; Joseph D. Lazar; H. Christoffersen

[57] ABSTRACT

A radar antenna includes a plurality of radiators disposed near the focal point of a parabolic reflecting surface. The radiators are coupled to a sector horn waveguide via a plurality of phase shifters and a Butler matrix. The sector horn is concurrently excited in $H_{10}$ and $H_{12}$ modes of propagation to provide excitation to the radiators. Radiated energy from a radiator propagates to the reflecting surface and is reflected therefrom.

6 Claims, 9 Drawing Figures

BEAM FORMING NETWORK

The government has rights in this invention pursuant to Contract No. F30602-76-C-02900 awarded by the United States Department of the Air Force.

BACKGROUND OF THE INVENTION

1. Field of Invention

This invention relates to radar and more particularly to propagating a selected one of a plurality of patterns of radar beams.

2. Description of the Prior Art

A plurality of aircraft on a bombing mission, for example, typically include what is known as an electronic countermeasure screen aircraft. The screen aircraft usually carries a transponder that transmits a simulated radar return signal in response to receiving energy from a beam transmitted by a radar. The simulated return signal has a wave front that corresponds to a position where none of the aircraft are located. Therefore, the simulated return signal may prevent the radar from being used to determine positions of the aircraft.

When the radar beam is narrow, the transponder does not receive energy unless the radar beam is directed to the screen aircraft. Therefore, the narrow radar beam can be readily used to determine the positions of aircraft, other than the screen aircraft.

When the narrow radar beam has a high gain and is directed to the screen aircraft, a strong return signal is reflected from the screen aircraft. Because the reflected return signal is strong, it is easily distinguishable from the simulated return signal. Therefore, when the radar is used for determining the position of the aircraft, it is desirable for the radar beam to be narrow and have high gain.

When the radar is used for searching for the aircraft, it is desirable to propagate the radar beam through a large search region. Additionally, it is desirable that a reflected return signal have an amplitude that is independent of the range from the antenna of the radar of an aircraft that maintains a constant altitude. The amplitude of the reflected return signal is independent of the range when the radar beam forms the well known cosecant square pattern. The cosecant square beam pattern is formed when energy of the radar beam at a location in the search area is proportional to the square of the cosecant of the angle subtended by a line between the location and the antenna and a datum line that passes through the antenna. Accordingly, it is desirable that the radar have a capability for transmitting either the narrow high gain beam or the cosecant square beam pattern.

SUMMARY OF THE INVENTION

According to the present invention, energy in an $H_{12}$ mode and an $H_{10}$ mode may be concurrently transmitted through a waveguide to provide therein a composite electric field that has an amplitude proportional to the amplitude of the inverse Fourier transform of a desired pattern of excitation of radiators of a radar antenna. Output signals from the waveguide are shifted in phase, in accordance with corresponding phase shifts of the inverse Fourier transform, and coupled to the radiators through a Butler matrix.

DESCRIPTION OF THE PREFERRED EMBODIMENT

Figure 1:
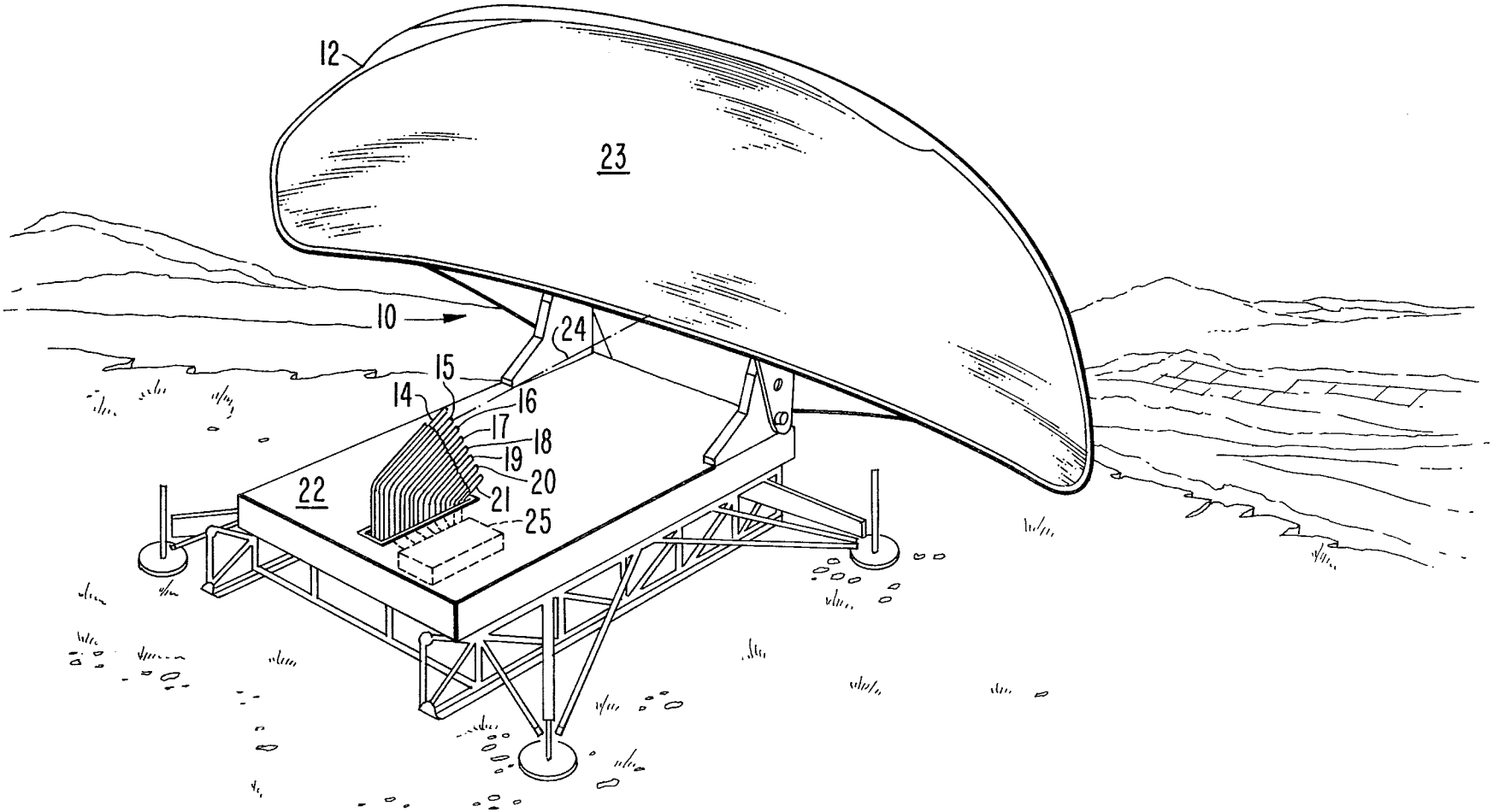
FIG. 1 is a perspective view of a preferred embodiment of the present invention.

As shown in FIG. 1, a mobile radar antenna 10 includes a reflector 12 and radiators 14–21 that are supported on a platform 22 which rests upon the ground. Reflector 12 has a reflecting surface 23 which is a parabolic surface of revolution about an axis 24. Radiators 14–21 are positioned in an elevation sector with radiator 15 disposed substantially at the focal point of surface 23.

As explained hereinafter, the output from a transmitter is provided in a desired pattern to radiators 14–21 via a microwave circuit 25 disposed within platform 22. The output from the transmitter causes a propagation of electromagnetic radiation from radiators 14–21 to surface 23.

Since radiator 15 is at the focal point, radiation therefrom is reflected from surface 23 as a high gain beam with a central axis colinear with axis 24. Because radiators 14 and 16–21 are not at the focal point, radiation therefrom is reflected from surface 23 as high gain beams with central axes angularly displaced from axis 24. Radiators 14–21 may be concurrently excited to cause surface 23 to reflect eight interleaved high gain beams that form the cosecant square beam pattern.

Figure 2:
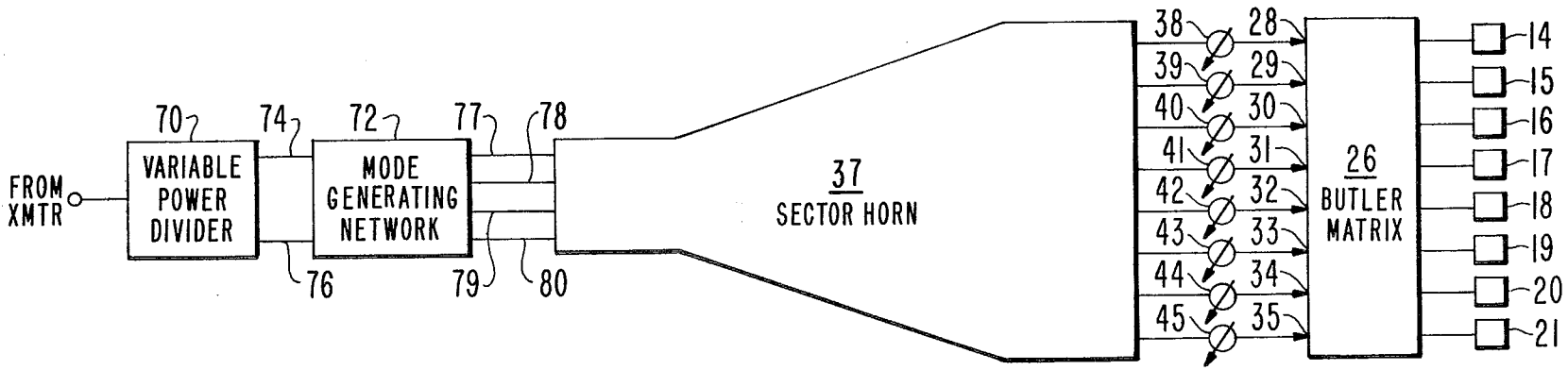
FIG. 2 is a block diagram of apparatus, including a Butler matrix, for providing excitation to radiators in the embodiment of FIG. 1.

As shown in FIG. 2, radiators 14–21 are connected to outputs of a Butler matrix 26 of circuit 25. Butler matrix 26 has input ports 28–35 where an input signal representation of an inverse discrete Fourier transform (DFT) of the desired pattern of excitation (of radiators 14–21) is applied. As known to those skilled in the art, in response to the input signal representation, Butler matrix 26 provides signals having the desired pattern of excitation. More particularly, signals provided by Butler matrix 26 are in accordance with a transform relationship which is given as:

$$b_n = \frac{1}{8} \sum_{M=14}^{21} a_m e^{j\phi(m,n)} \qquad (1)$$

where

- $n$ is a reference number of an input to Butler matrix 26;
- $m$ is a reference number of a radiator;
- $b_n$ is the amplitude of a signal applied to an input of Butler matrix 26;
- $a_m$ is the amplitude of a signal provided to a radiator having the reference number, $m$;

$$\phi(m,n) = \delta_m(n - 27 - \frac{9}{2}); \text{ and}$$

$$\delta_m = \frac{\pi}{4}(\frac{9}{2} - m - 13)$$

Figure 3:
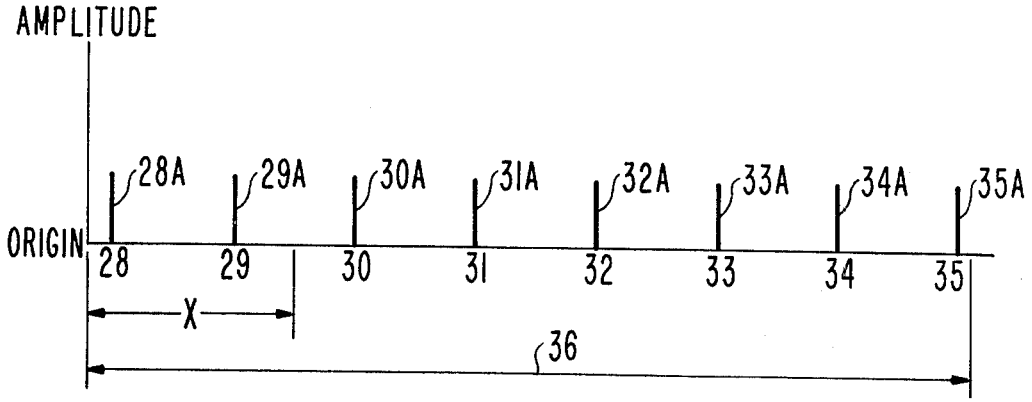
FIG. 3 is a graph of signals applied to the Butler matrix of FIG. 2.
Figure 4:
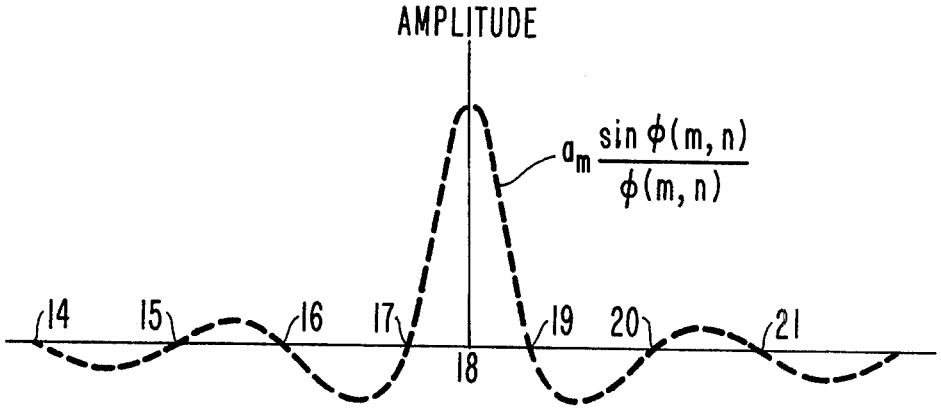
FIG. 4 is a graph of the output of the Butler matrix of FIG. 2 in response to the application of the signals of FIG. 3.

As explained hereinafter, the maximum excitation is provided to one of radiators 14–21 when signals of equal amplitude are applied to ports 28–35. As shown in FIG. 3, input signals having equal amplitudes 28A–35A, are applied to ports 28–35, respectively. Ports 28–35 are represented along an abscissa as evenly spaced points within a range of interest 36. As shown in FIG. 4, in response to the signals with amplitudes 28A–35A, Butler matrix 26 provides a pattern of signals that satisfy a relationship which is given as:

$$a_m = b_n \frac{\sin\phi(m,n)}{\phi(m,n)} \quad (2)$$

It should be understood that $$b_n \frac{\sin\phi(m,n)}{\phi(m,n)}$$

has a maximum value, $b_n$, when the angle, $\phi(m,n)$, equals zero. As well known to those skilled in the art, the phase of the signals with amplitudes 28A–35A may be adjusted to cause Butler matrix 26 to provide a maximum excitation, represented by the term, $b_n$, to a selected one of radiators 14–21. Moreover, excitation provided to all others of radiators 14–21 is representative of nulls of $$b_n \frac{\sin\phi(m,n)}{\phi(m,n)}$$

whereby excitation is provided to the selected one of radiators 14–21. In other words, the signals with amplitudes 28A–35A is a representation of a discrete inverse Fourier transform of a pattern where the excitation is provided to one of the radiators 14–21.

Figure 5:
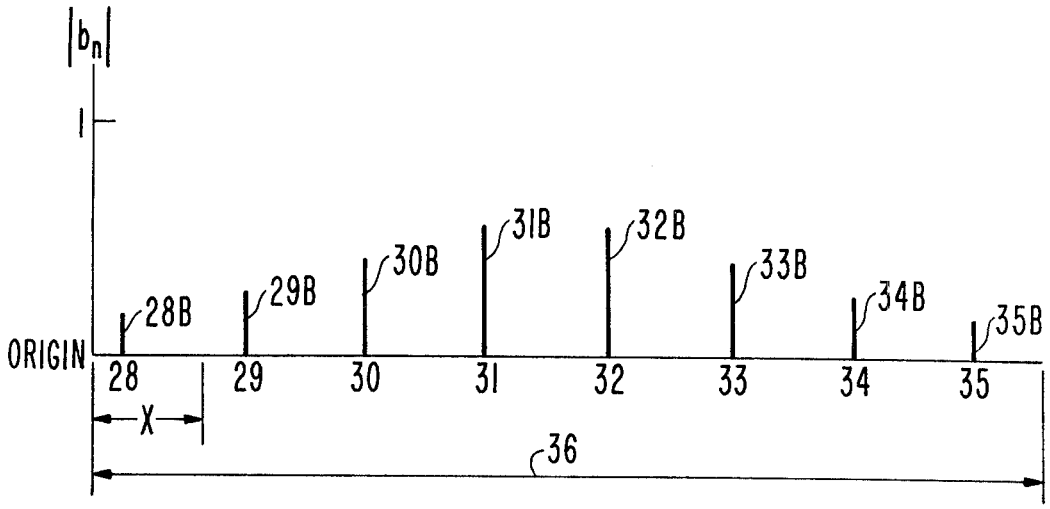
FIG. 5 is a graph of the amplitudes of signals applied to the Butler matrix of FIG. 2.
Figure 6:
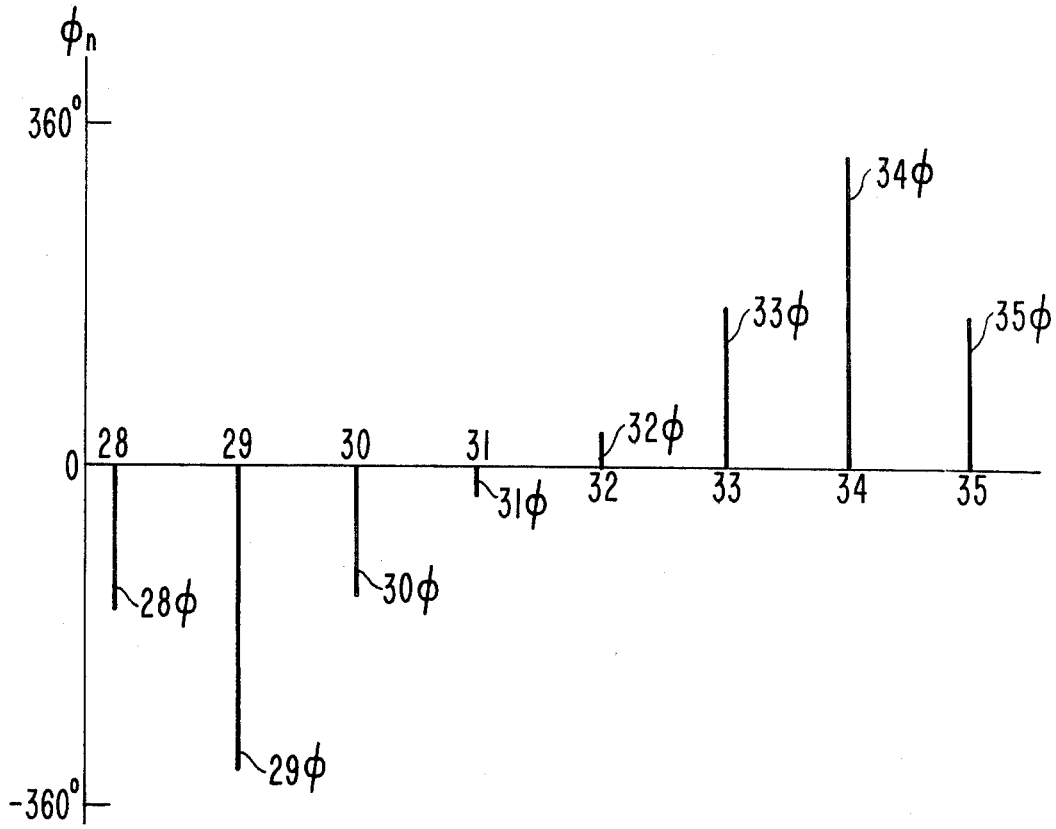
FIG. 6 is a graph of the phase shifts of signals applied to the radiators of FIG. 2.

As shown in FIGS. 5 and 6, surface 23 reflects the eight beams that form the cosecant square beam pattern when input signals that have amplitudes 28B–35B and phase shifts 28$\phi$–35$\phi$ are applied to inputs 28–35, respectively. In other words, the signals with amplitudes 28B–35B and phase shifts 28$\phi$–35$\phi$, respectively, are a representation of a discrete inverse Fourier transform of a pattern of excitation that results in the eight beams that form the cosecant square beam pattern.

As explained hereinafter, signals that either have amplitudes 28A–35A (FIG. 3) or amplitudes 28B–35B (FIG. 5) may be provided at outputs of a sector horn 37 (FIG. 2) of circuit 25 in accordance with an amplitude relationship which is given as:

$$F = K_1 + K_2 \cos\frac{2\pi X}{A} \quad (3)$$

where $K_1$ and $K_2$ are constants;

A equals range of interest 36 (FIGS. 3 and 5);

X is a displacement from the origin along the abscissa in either FIG. 3 or FIG. 5; and F is the amplitude of a signal provided at an output of sector horn 37.

It should be appreciated that when the constant, $K_2$, equals zero, the amplitude relationship (3) is a representation of amplitudes 28A–35A (FIG. 3); non-zero values of $K_1$ and $K_2$ may be selected to cause the amplitude relationship (3) to be a representation of amplitudes 28B–35B (FIG. 5).

Outputs from sector horn 37 are coupled through phase shifters 38–45 to radiators 14–21, respectively. Each of phase shifters 38–45 is operable to provide an output signal with any desired phase shift with respect to an input signal provided thereto, with the amplitude of the output signal substantially equal to the amplitude of the input signal. A signal representation of desired phase shifts may be provided, to phase shifters 38–45, for example, by a computer (not shown). However, any suitable means may be utilized to provide the signal representation of the phase shifts.

Hence, when sector horn 37 provides signals having amplitudes 28A–35A (FIG. 3), phase shifters 38–45 are operable to provide phase shifts that cause Butler matrix 26 to provide the maximum excitation (represented by the term, $b_n$) to a selected one of radiators 14–21. When sector horn 37 provides signals having amplitudes 28B–35B (FIG. 5), phase shifters 38–45 are operable to provide phase shifts 28$\phi$–35$\phi$ (FIG. 6), thereby causing the reflection of the eight beams that form the cosecant square beam pattern.

Figures 7, 8, 9:
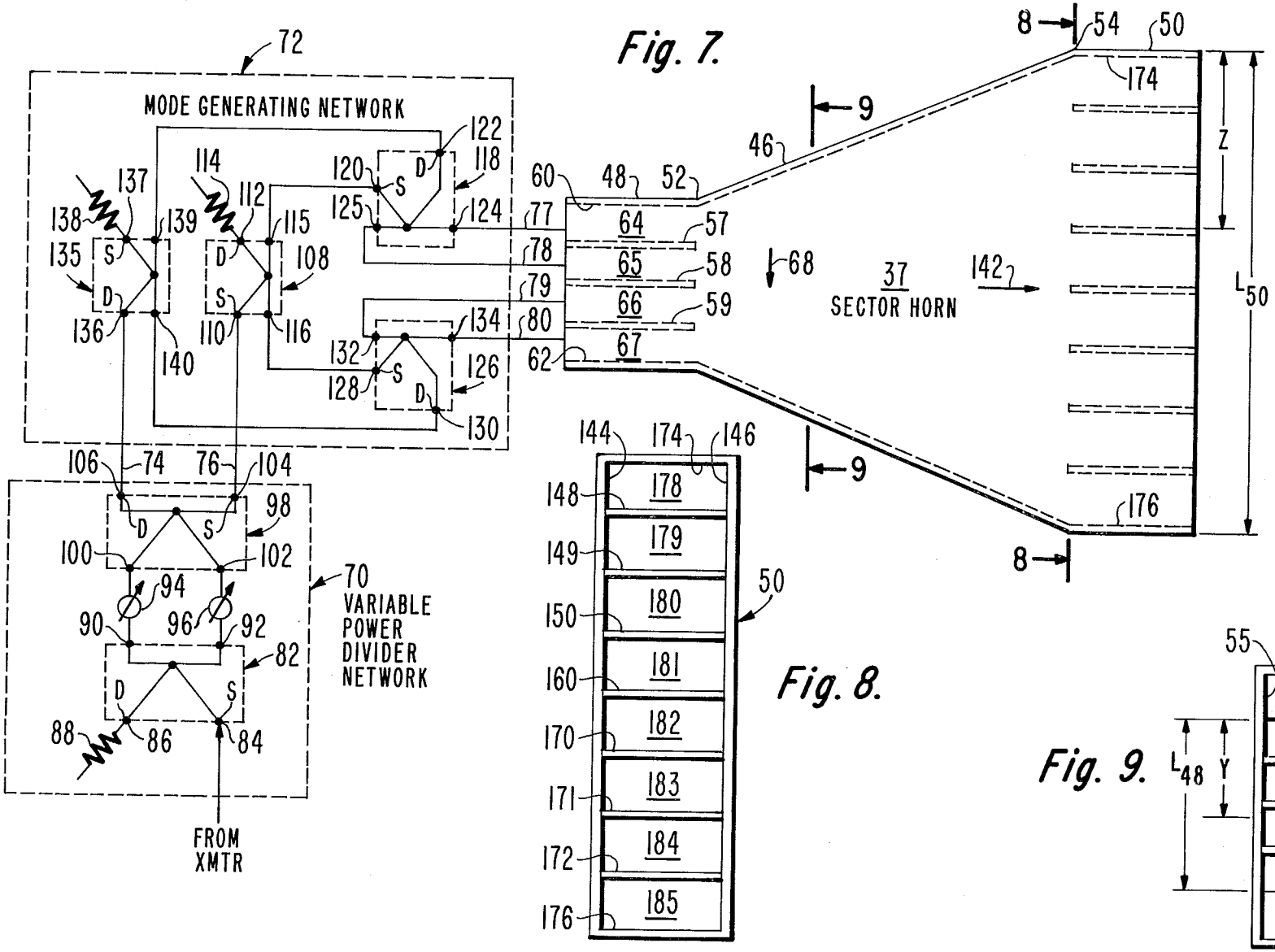
FIG. 7 is a schematic diagram of some of the apparatus of FIG. 2.
FIG. 8 is a view of FIG. 7 taken along the line 8—8.
FIG. 9 is a view of FIG. 7 taken along the line 9—9.

As shown in FIGS. 7–9, sector horn 37 includes a tapered waveguide portion 46 that has a rectangular cross section. Sector horn 37 additionally includes rectangular waveguide portions 48 and 50 that are integrally connected to tapered waveguide 46 at small end 52 and large end 54 thereof, respectively.

Waveguide 48 has interior side surfaces 55 and 56 (FIG. 9) that are connected in any suitable manner to rectangular metal sheets 57–59. The surfaces of sheets 57–59 are maintained parallel to a top interior surface 60 of waveguide 48 and a bottom interior surface 62 thereof. Moreover, sheets 57–59 divide the cavity of waveguide 48 into small rectangular waveguides 64–67, which are all of similar shape and substantially equal volume.

In this embodiment, waveguides 64–67 are each excited to provide therein transverse electric fields in the direction of an arrow 68 (FIG. 7) which is normal to the surfaces of sheets 57–59. The respective transverse fields combine to form a composite field in the direction of arrow 68. The composite field has a strength in accordance with an excitation relationship that is given as:

$$E_{T1} = E_{10} + E_{12} \cos\frac{2\pi Y}{L_{48}} \quad (4)$$

where $E_{T1}$ is the strength of the composite field within waveguide 48;

$E_{10}$ is the strength of a transverse field that has an $H_{10}$ mode of propagation through waveguide 48;

$E_{12}$ is the maximum strength of a transverse field that has an $H_{12}$ mode of propagation through waveguide 48;

Y is a displacement from surface 60 to a location within waveguide 48; and $L_{48}$ is the distance between surfaces 60 and 62.

It should be appreciated that the excitation relationship (4) is of the same form as the amplitude relationship (3) given hereinbefore. In other words, waveguide 48 combines transverse fields that have the $H_{10}$ and $H_{12}$ modes of propagation. Since the excitation relationship (3) and the amplitude relationship (4) have the same form, the composite field has amplitudes that are representative of the amplitudes of a discrete inverse Fourier transform of a desired pattern of excitation of radiators 14–21. When the composite field propagates to outputs of sector horn 37, signals that either have amplitudes 28A–35A or amplitudes 28B–35B may be provided by sector horn 37.

Circuit 25 additionally includes a power divider network 70 (FIGS. 2 and 7) with outputs connected to inputs of a mode generating network 72 through an $H_{12}$ signal line 74 and an $H_{10}$ signal line 76. The output of mode network 72 is connected to sector horn 37 through transmission lines 77–80. The excitation of waveguides 64–67 is provided by coupling the output from the transmitter through power divider network 70 (FIG. 2) to mode network 72.

Within power divider 70 (FIG. 7) is a magic TEE network 82 that has a sum port 84 which is connected to the output of the transmitter. Additionally, magic TEE 82 has a difference port 86 that is connected to a terminating resistor 88. Resistor 88 dissipates parasitic signals that may be undesirably coupled to difference port 86. However, no signal is provided to difference port 86. Outputs from magic TEE 82 are provided at signal ports 90 and 92, thereof.

As well known to those skilled in the art, in a magic TEE network, signals at a sum port and a difference port are proportional to the sum and difference, respectively, of signals at a pair of signal ports of the magic TEE. Since no signal is provided at difference port 86, cophased signals of equal amplitude are provided at ports 90 and 92 in response to the output from the transmitter.

Ports 90 and 92 are connected to inputs of phase shifters 94 and 96, respectively, which are of a type similar to phase shifters 38–45, described hereinbefore. Outputs of phase shifters 94 and 96 are connected to a magic TEE network 98 at signal ports 100 and 102, respectively, thereof. Addditionally, magic TEE 98 has a sum port 104 and a difference port 106 connected to mode network 72 through $H_{12}$ line 74 and $H_{10}$ line 76, respectively, which are described hereinbefore.

When, for example, phase shifters 94 and 96 provide signals that are in phase with each other, a signal derived from the transmitter is applied by magic TEE 98 to the $H_{10}$ line 76; no signal is applied to the $H_{12}$ line 74. Corresponding, when phase shifters 94 and 96 provide signals that are out of phase with each other, a signal derived from the transmitter is applied to $H_{12}$ line 74; no signal is applied to $H_{10}$ line 76. Since phase shifters 94 and 96 are operable to cause any desired phase shift, power divider 70 is operable to apply signals on $H_{10}$ line 76 and $H_{12}$ line 74 in any desired ratio. A signal representation of the desired ratio is provided to phase shifters 90 and 96 by the computer referred to above in connection with phase shifters 38–45.

As explained hereinafter, the amplitude of the signal applied to $H_{10}$ line 76 is proportional to the amplitude of the term, $E_{10}$, in the excitation relationship (4). Moreover, the amplitude of the signal applied to $H_{12}$ line 74 is proportional to the amplitude of the term, $E_{12}$, in the excitation relationship (4).

Within mode network 72, $H_{10}$ line 76 is connected to a magic TEE network 108 at a sum port 110 thereof. Additionally, magic TEE 108 has a difference port 112 connected to a terminating resistor 114, similar to terminating resistor 88 described hereinbefore. Therefore, no signal is provided to difference port 112. In response to a signal being applied to $H_{10}$ line 76, cophased signals of equal amplitude are provided at signal ports 115 and 116 of magic TEE 108.

Signal port 115 is connected to a magic TEE network 118 at a sum port 120 thereof. Additionally, magic TEE 118 has a difference port 122 which is connected as described hereinafter. For reasons given hereinbefore, when a signal is provided to sum port 120, cophased signals of equal amplitude are provided at signal ports 124 and 125 of magic TEE 118.

In a manner similar to that described in connection with signal port 115, signal port 116 is connected to a magic TEE network 126 at a sum port 128 thereof. Additionally, magic TEE 126 has a difference port 130 which is connected as described hereinafter. Similar to magic TEE network 118, in response to a signal being provided to sum port 128, cophased signals of equal amplitude are provided at signal ports 132 and 134 of magic TEE 126.

Ports 124, 125, 132, 134 are coupled to waveguides 64–67 through transmission lines 77–80, respectively. From the explanation given hereinbefore, in response to a signal being applied to $H_{10}$ line 76, cophased signals of equal amplitude are applied to waveguides 64–67. Additionally, the amplitudes of the cophased signals applied to waveguides 64–67 are proportional to the signal applied to $H_{10}$ line 76. As well known to those skilled in the art, the cophased signals of equal amplitude establish the component of the composite field that has the $H_{10}$ mode of propagation ($E_{10}$) referred to in connection with the excitation relationship (4). Moreover, the strength of the $H_{10}$ component is proportional to the amplitudes of the cophased signals. The component of the composite field that has the $H_{12}$ mode of propagation ($E_{12}$) is established in a manner described hereinafter.

Within mode network 72, $H_{12}$ line 74 is connected to magic TEE 135 at a difference port 136 thereof. Additionally, magic TEE 135 has a sum port 137 connected to a terminating resistor 138, similar to terminating resistor 88. Therefore, no signal is applied to sum port 137. In response to a signal being applied to $H_{12}$ line 74, signals of equal amplitude and opposite phase are provided at signal ports 139 and 140 of magic TEE 135.

Signal ports 139 and 140 are connected to difference ports 122 and 130, respectively, which were referred to hereinbefore. Therefore, in response to a signal being applied to $H_{12}$ line 74, signals of one phase are applied to waveguides 65 and 66 via lines 78 and 79; signals of an opposite phase are applied to waveguides 64 and 67 via lines 77 and 80. Additionally, the amplitude of the signals with opposite phase is proportional to the signal applied to $H_{12}$ line 74. Since waveguides 64 and 67 are bounded by surfaces 60 and 62, respectively, and waveguides 65 and 66 are between waveguides 64 and 67, the signal applied to $H_{12}$ line 74 establishes the component of the composite field that has the $H_{12}$ mode of propagation. Moreover, the strength of $H_{12}$ component is proportional to the amplitudes of the signals with opposite phase.

The composite field propagates through sector horn 37 in the direction of an arrow 142 (FIG. 7) to waveguide 50. Waveguide 50 (FIG. 8) has interior side surfaces 144 and 146 that are connected in any suitable manner to rectangular sheets 148–172. Surfaces of sheets 148–172 are maintained parallel to a top interior surface 174 of waveguide 50 and a bottom interior surface 176 therof. Moreover, sheets 148–172 divide the cavity of waveguide 50 into rectangular waveguides 178–185, which are all of substantially the same volume and shape.

It should be appreciated, that the distance between surfaces 174 and 176 is greater than the distance between surfaces 60 and 62. Because of the difference between the distances, within waveguide 50 the strength of the composite field is in accordance with an output relationship that corresponds to the excitation relationship (4). The output relationship is given as:

$$E_{T2} = E_{10} + E_{12} \cos \frac{2\pi Z}{L_{50}} \quad (5)$$

where $E_{T2}$ is the strength of the composite field within waveguide 50;

Z is a displacement from surface 174 to a location within waveguide 50; and $L_{50}$ is the distance between surfaces 174 and 176.

Waveguides 178–185 are coupled in any suitable manner to the inputs of phase shifters 38–45, respectively (FIG. 2). Because the composite field within waveguide 50 is in accordance with the output relationship, signals are applied to phase shifters 38–45 in accordance with the amplitude relationship (3).

It should be understood that the distance between surfaces 174 and 176 is made greater than the distance between surfaces 64–67 because eight phase shifters are connected to waveguide 50 whereas only four transmission lines are connected to waveguide 48. In other words, the greater distance is to provide for a greater number of connections. In an alternative embodiment, a rectangular waveguide may be included instead of sector horn 37.

What is claimed is:

1. A network for providing excitation in a desired pattern to a plurality of radiators of an antenna in response to an output from a transmitter, comprising:

waveguide means for combining a field that has a known direction and an $H_{10}$ mode of propagation with a field that has said known direction and an $H_{12}$ mode of propagation, said propagations being from an input end to an output end of said waveguide means, thereby providing a composite field at said output end that has amplitudes that are a representation of amplitudes of a discrete inverse Fourier transform of said desired pattern;

excitation means adapted for connection to said transmitter for concurrently causing said $H_{10}$ mode and said $H_{12}$ mode of propagation;

phase shifting means connected to said output end for providing a signal representation of said discrete inverse Fourier transform; and a Butler matrix with inputs and outputs connected to said phase shifting means and to said radiators, respectively.

2. The network of claim 1 wherein said waveguide excitation means comprises:

power divider means for providing an $H_{10}$ signal and an $H_{12}$ signal in any desired ratio in response to said output from said transmitter; and mode generating means connected to said power divider means for establishing a composite electric field at said input end in accordance with an excitation relationship which is given as:

$$E_{T1} = E_{10} + E_{12} \cos \frac{2\pi Y}{L}$$

where $E_{T1}$ is the strength of the composite field;

$E_{10}$ is the strength of a component of said field that has an $H_{10}$ mode of propagation through said waveguide, $E_{10}$ being proportional to said $H_{10}$ signal;

$E_{12}$ is the maximum strength of a component of said field that has substantially the same direction as said $E_{10}$ component and an $H_{12}$ mode of propagation through said waveguide, $E_{12}$ being proportional to said $H_{12}$ signal;

Y is a displacement of a location within said waveguide at said input end from a wall that is substantially perpendicular to the direction of said component fields; and L is the distance between said wall and an opposite wall of said waveguide.

3. The network of claim 2 wherein said power divider means comprises:

a first magic TEE network having a signal port that receives said output from said transmitter;

a first phase shifter having an input connected to a sum port of said first magic TEE;

a second phase shifter having an input connected to a difference port of said first magic TEE, said phase shifters being operable to provide an output signal of any desired phase with respect to a signal applied thereto; and a second magic TEE network having sum and difference ports connected to the outputs of said first and second phase shifters, respectively, whereby said $H_{10}$ and $H_{12}$ signals are provided at signal ports of said second magic TEE.

4. The network of claim 2 wherein said mode generating means comprises means for applying to first and second pairs of lines cophased signals of a first amplitude proportional to said $H_{10}$ signal, and for applying to said first and second pairs of lines signals of a second amplitude with a known phase and signals of said second amplitude with a phase opposite from said known phase, respectively, said second amplitude being proportional to said $H_{12}$ signal.

5. The network of claim 2 wherein said mode generating means comprises:

a first network means for providing first and second cophased signals with an equal amplitude that is proportional to said $H_{10}$ signal;

a second network means for providing third and fourth signals of opposite phase with an equal amplitude that is proportional to said $H_{12}$ signal;

a magic TEE network with a first sum port and a first difference port connected to said first and second means, respectively, to cause said first signal to be provided to said first sum port and said third signal to be provided to said first difference port; and a magic TEE network with a second sum port and a second difference port connected to said first and second means respectively, to cause said second signal to be provided to said second sum port and said fourth signal to be provided to said second difference port.

6. The network of claim 1 wherein said waveguide means comprises:

a tapered waveguide having a rectangular cross section, whereby said tapered waveguide has a small end and a large end;

a first rectangular waveguide having one end contiguously connected to said small end, whereby said composite field is propagated from said first waveguide through said tapered waveguide;

three rectangular metal sheets that divided the cavity of said first waveguide into four waveguides of similar shape and substantially equal volume; said four waveguides being connected to said excitation means;

a second rectangular waveguide having one end contiguously connected to said large end, whereby said composite field from said tapered waveguide is propagated through said second waveguide; and a plurality of rectangular metal sheets that divide the cavity of said second waveguide into a plurality of waveguides of similar shape and substantially equal volume.

* * * * *